United States Patent [19]

Yamada

[11] Patent Number: 4,854,516

[45] Date of Patent: Aug. 8, 1989

[54] TRAVERSE DRUM

[75] Inventor: Shoji Yamada, Inuyama, Japan

[73] Assignee: Murata Kikai Kabushiki Kaisha, Kyoto, Japan

[21] Appl. No.: 80,236

[22] Filed: Jul. 28, 1987

Related U.S. Application Data

[63] Continuation of Ser. No. 774,296, Sep. 10, 1985, abandoned.

[30] Foreign Application Priority Data

Sep. 12, 1984 [JP] Japan ..... 59-191258

[51] Int. Cl.[4] ..... B65H 59/00

[52] U.S. Cl. ..... 242/43.2

[58] Field of Search ..... 254/371, 374; 242/43.2, 242/117

[56] References Cited

U.S. PATENT DOCUMENTS 3,356,308 12/1967 Kubo et al. ..... 242/43.2

4,383,654 5/1983 Kawamura ..... 242/43.2

*Primary Examiner*—Richard K. Seidel

*Attorney, Agent, or Firm*—Spensley Horn Jubas & Lubitz

[57] ABSTRACT

A grooved traverse drum for an automatic winder and method for manufacturing the same. An iron metal traverse drum having extremely thin walls is formed by instantaneously injecting a molten metal into a limited cavity of a mold having a form corresponding to the traverse drum in an oxygen-free atmosphere.

3 Claims, 8 Drawing Sheets

TRAVERSE DRUM

This is a continuation of application Ser. No. 06/774,296 filed on Sept. 10, 1985, now abandoned.

BACKGROUND OF THE INVENTION

1. Field of the Invention

The present invention relates to a traverse drum and a method for manufacturing the same.

2. Prior Art

There have been proposed various grooved traverse drums for automatic winders for winding yarns. The grooved traverse drum are used for surface-driving a take-up package at a high revolving rate and also for traverse a yarn drawn out from a supply package at a high traversing speed. Accordingly, the traverse drum is required to meet various operating conditions. The traverse drum are required to meet the following conditions in respect of function and manufacture.

(i) The traverse drum needs to be an electrically conductive body capable of conducting static electricity generated during the winding operation so that the traverse drum will not be charged.

(ii) The portions to be in contact with a yarn must be abrasion-resistant.

(iii) The traverse drum needs to be capable of breaking ribboning which occurs when the traverse drum and the take-up package are the same in diameter, and needs to be lightweight so that the traverse drum can be stopped instantly upon the occurence of yarn breakage.

(iv) The surface of the traverse drum must have a low coefficient of friction.

(v) Manufacturing processes including a process for forming the complicated grooves must be carried out easily.

(vi) The traverse drum must be stable in accuracy and can be produced at a low manufacturing cost.

As regards Item (i), the surface of some traverse drum is coated, for example with a film of an antistatic agent or a static electricity preventive agent. However such a traverse drum suffers from the abrasion of the film and the abrasion of the body of the drum. As regards Item (ii), metallic pins having a high hardness or ceramic pins are burried in the drum along the yarn passage to prevent abrasion. However such means requires complex manufacturing processes and has problems in respect of quality and cost. As regards Items (iv) and (v), some drum bodies are formed by an aluminum alloy to reduce the weight to 1.5 to 2.0 kg. However, aluminum alloys are inferior in abrasion resistance. In order to improve the abrasion resistance, such a traverse drum is treated to coat the surface with a hard alumite film, however, the hardness of a hard alumite film is, at the most, about 500 Hv and, since an alumite film is nonconductive, the traverse drum is liable to be charged with static electricity.

Accordingly in view of improving the abrasion resistance of the traverse drum, it is desirable to form the traverse drum by a ferroalloy. However, ferroalloys have various drawbacks that the specific weight thereof is 2.6 to 3.1 times that of aluminum alloys the melting point is high, the manufacturing cost of ferroalloys is high and ferroalloys ar hard and less workable than aluminum alloys. Consequently, traverse drum formed by ferroalloys have not widely been used.

SUMMARY OF THE INVENTION

The present invention has been made to solve all those various problems and provides a novel traverse drum and a method for manufacturing the same.

A traverse drum of the present invention is formed in an integral structure of an iron metal including guide grooves and other portions through oxygen-free casting and has extremely thin walls. The weight of the traverse drum of the present invention is approximately the same as that of an equivalent traverse drum formed by an aluminum metal.

According to the present invention, an iron metal traverse drum having extremely thin walls, which has been impossible to be formed in the atmosphere, is formed by instantaneously injecting a molten metal into limited cavity of a mold having a form corresponding to the traverse drum, in an oxygen-free atmosphere filled with argon gas or nitrogen gas.

DESCRIPTION OF THE PREFERRED EMBODIMENTS

The preferred embodiments of the present invention will be described hereinafter referring to the accompanied drawings.

Figure 1:
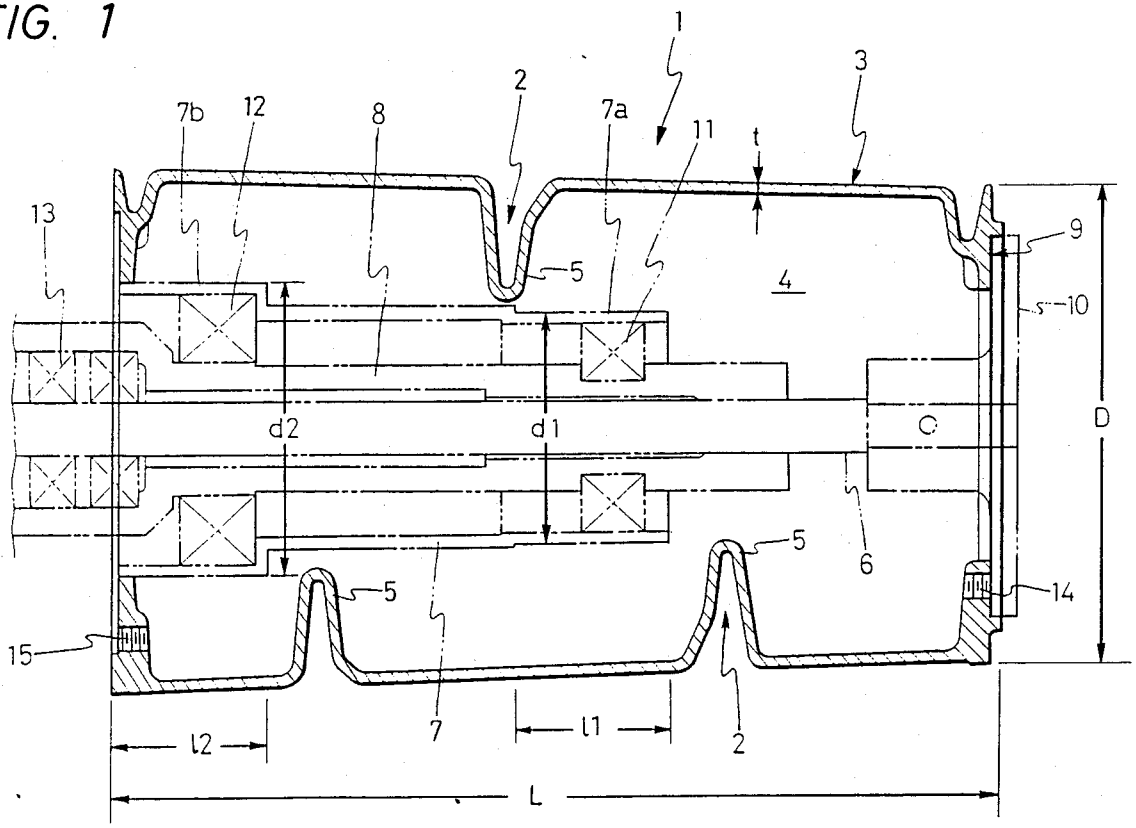
FIG. 1 is a sectional front elevation of a traverse drum according to the present invention.

FIG. 1 is a sectional view of a traverse drum 1 according to the present invention. The drum 1 is formed in an integral body by casting an iron metal and a ferroalloy. The drum 1 has guide grooves 2 and has walls having practically the same extremely small wall thickness t. That is, the thickness of the wall of the guide grooves 2 and that of the wall of the cylindrical wall 3 are approximately 1.5 to 2.5 mm. The weight of the traverse drum 1 is about 1.5 kg, which is substantially the same as that of an equivalent cast aluminum traverse drum. Naturally, the weight of the traverse drum is dependent also on the length L and the average diameter D, in a standard traverse drum, the length L is approximately 150 mm and the average diameter D is approximately 90 mm, and then the weight of such a traverse drum is approximately 1.5 kg.

Possible iron metals are gray cast irons (FC), spheroidal graphite cast irons (FCD), stainless steels and the like. The iron metal of a suitable composition is used selectively taking into consideration the strength and toughness of the material. Any material other than the iron metals and ferroalloys may be used as far as the material meets the requisite conditions of the traverse drum, such as those concerning electric conductivity, abrasion resistance and frictional performance of the surface.

When the traverse drum is formed by an iron material, the traverse drum is subjected to surface treatment to provide the surface thereof with excellent abrasion resistance. The surface hardness of an as-cast iron casting is at the most 200 to 400 Hv, therefore, the surface hardness of such a casting needs to be enhanced to an appropriate hardness through a surface treatment, such as ion nitriding treatment or ion plating which hardens the surface up to a hardness in the range of 800 to 1000 Hv, titanium nitriding treatment which hardens the surface up to a hardness in the range of 1600 to 2000 Hv or surface treatment using titanium carbide which hardens the surface up to a hardness in the range of 3300 to 5000 Hv. Thus a hard layer of several microns to ten-odd microns thickness is formed over the entire surface of the traverse drum 1 including the surfaces of the grooves 2.

The depth of the grooves 2 varies, and hence the projecting length of the walls 5 of the grooves 2 projecting inside the drum 1 varies. The inner surface of the walls 5 is finished by grinding so that a housing 7 for supporting a driving shaft 6 can be fitted in the traverse drum 1. The portions, not shown, of the projecting walls 5 corresponding to the bearing portions 7*a* and 7*b* of the housing 7 are finished by precision grinding so that the respective diameters of those portions are d1 and d2, respectively. The housing 7 is inserted from one end of the drum 1 and fitted close in the drum 1 and the driving shaft 6 is inserted through a fixed cylindrical member 8. The free end of the driving shaft 6 is fixed to an end cap 10 fixed to the other end of the drum 1. Bearings 11 and 12 and bearings 13 are provided between the housing 7 and the cylindrical member 8 and between the driving shaft 6 and the cylindrical member 8, respectively.

Threaded holes 14 and 15 which receive screws for fixing the end cap 10 and an end disk to one end remote from a driving unit and to the other end near the driving unit of the drum 1, respectively, after casting. In this embodiment, the thicknesses of the portions in which the threaded holes 14 and 15 are formed are somewhat larger than the wall thickness t of other portions of the drum 1, however, the drum 1 may be formed by walls having the same thickness t. It is preferable to form the portions for supporting the housing 7 in a wall thickness greater than the wall thickness of other portions.

A method for manufacturing the traverse drum 1 of the present invention will be described hereinafter.

According to a method for manufacturing a metallic traverse drum, such as the traverse drum 1, a desired molten metal is injected instantaneously in an oxygen-free atmosphere into a limited cavity having the same form as that of a traverse drum to be manufactured, in the strict sense, a limited cavity having a form having a wall thickness slightly greater than the wall thickness t of a traverse drum to be manufactured, to manufacture a metallic traverse having extremely thin walls.

The processes of the method for manufacturing a traverse drum according to the present invention will be described in connection with the accompanying drawings.

Figure 2:
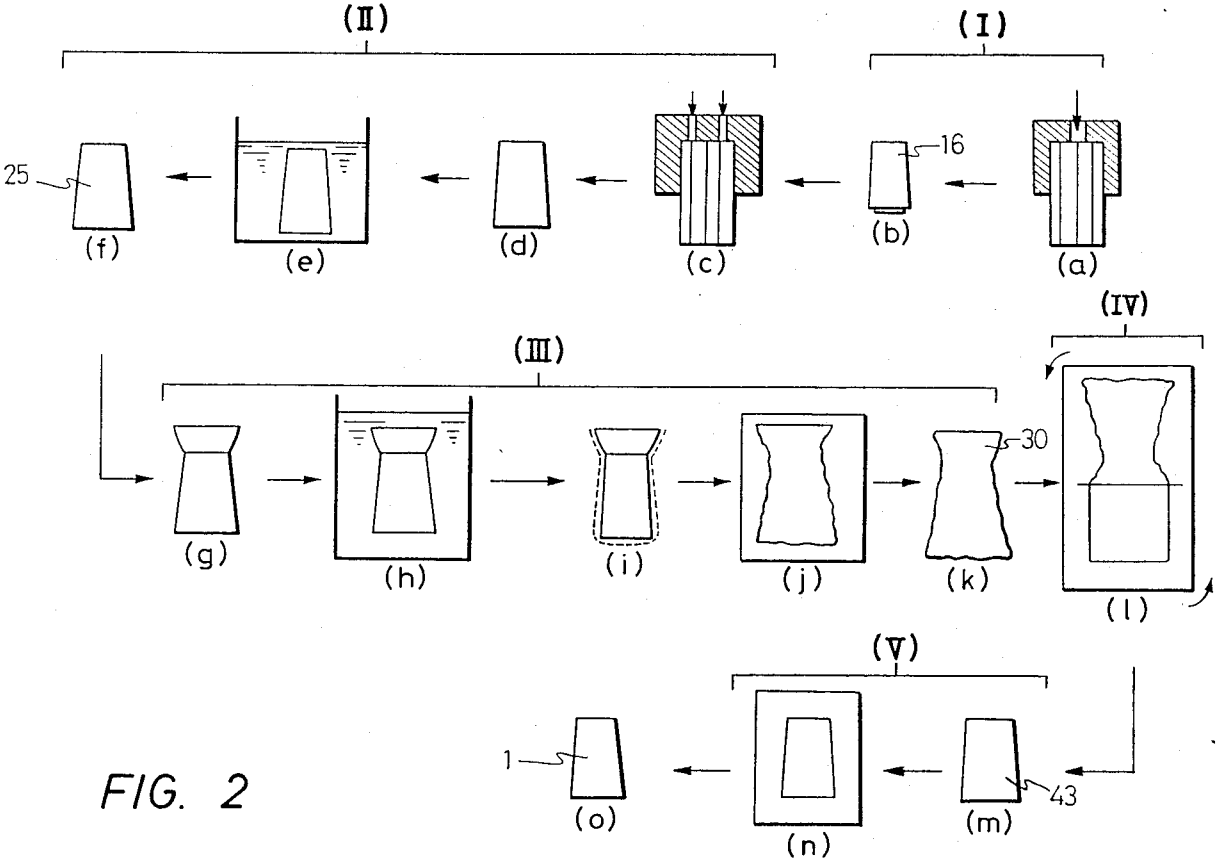
FIG. 2 is a block diagram showing the processes of a method for manufacturing a traverse drum according to the present invention.
Figure 3:
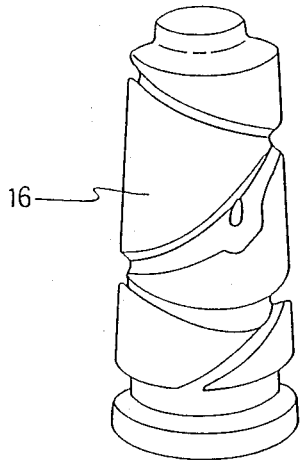
FIG. 3 is a perspective view of a core.

(I) Soluble core manufacturing process:

First, a soluble core 16 as shown in FIG. 3, having an internal space 4 shown in FIG. 1 is formed. The soluble core ((b) in FIG. 2) remains in a solid form under a certain condition and melts or breaks into particles under another condition.

Figure 4:
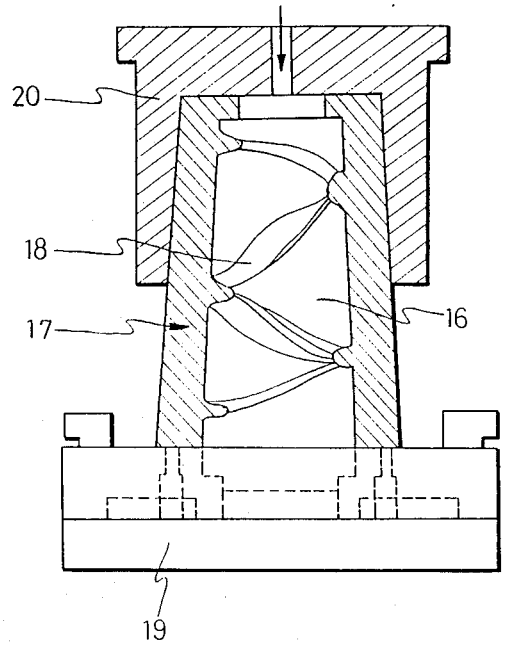
FIG. 4 is a sectional view for assistance in explaining a process for forming the core.

As shown in FIG. 4, the female mold 17 of the core 16 to be formed, having the entire form of the core 16 to the details of the grooves 18 is placed on a base plate 19, a mold setting cap 20 is put on the female mold 17, and then a solution of a first soluble substance is poured ((a) in FIG. 2) into the internal space of the female mold 17 to form the core 16.

Possible substances for forming the core 16 are those which dissolves in water, a gas, an oil or a chemical under a fixed condition, such as a water-soluble wax, a urea resin, salt, naphthalene and borax. In this embodiment, a urea resin soluble in water of an ordinary temperature is used.

Figure 7:
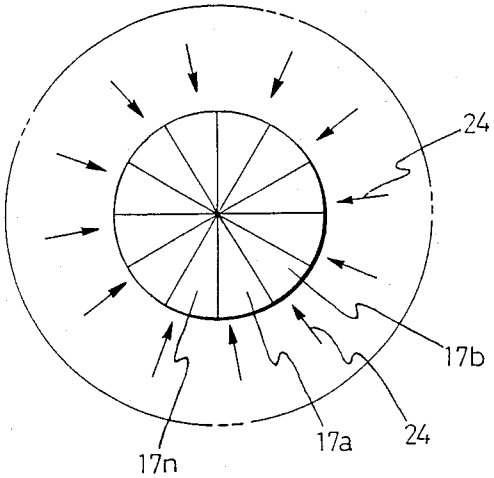
FIG. 7 is a plan view showing a mold for forming the core or the model drum, in an assembled state.
Figure 8:
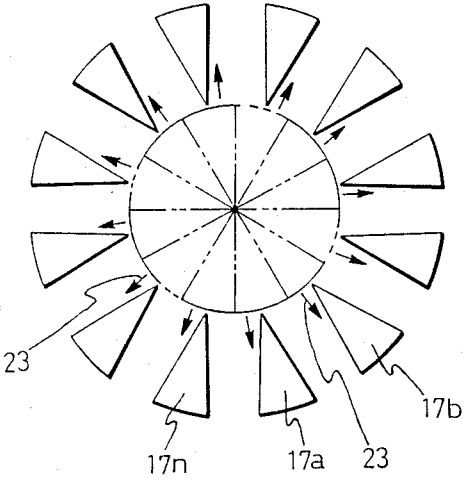
FIG. 8 is a plan view showing the mold of FIG. 7 in a disassembled state.
Figure 9:
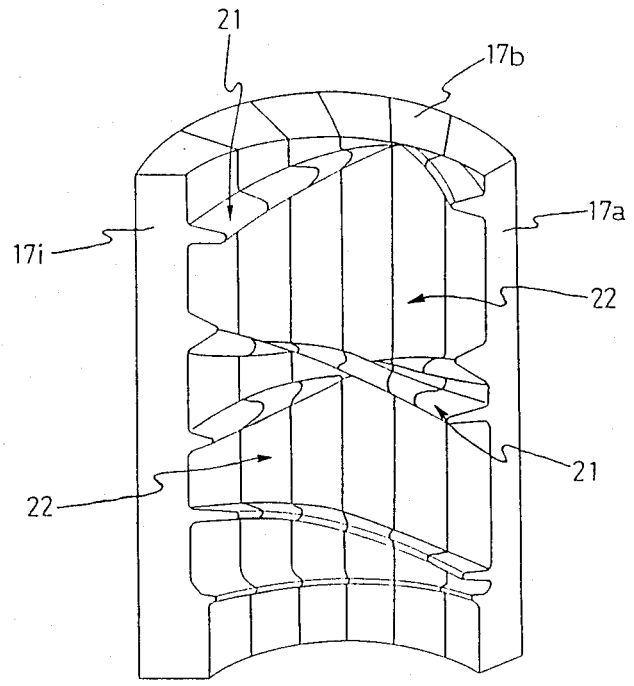
FIG. 9 is a fragmentary perspective view showing the assembled mold of FIG. 7.

Since the core 16 has grooves of complicated form and varying depth, the molded core 16 cannot be removed from the female mold 17 when the same is a conventional two-part mold. Therefore, the female mold 17 is a composite mold divided longitudinally into at least three segments 17*a* to 17*n* capable of being radially divided as illustrated in FIGS. 7 to 9. The number of segments of the female mold 17 for forming a molding such as a traverse drum having a complex morphology is preferably ten or above, and the suitable number of the segments is sixteen. Such a composite female mold 17 enables the molding to be removed easily from the female mold 17 without neither being broken nor being deformed.

When the segments 17*a* to 17*n* are assembled as illustrated in FIG. 7 by being pressed in directions indicated by arrows, a continuous inner surface 22 having protrusions 21 corresponding to the grooves and defining an internal space having the exact form of the core is formed as illustrated in FIG. 9. The water-soluble wax is poured into the female mold 17. After the urea resin was solidified, the mold setting cap 20 is removed and the segments of the female mold 17 are opened radially as indicated by arrows in FIG. 8 to remove the soluble core 16 from the female mold 17 without damaging the grooves.

Figure 5:
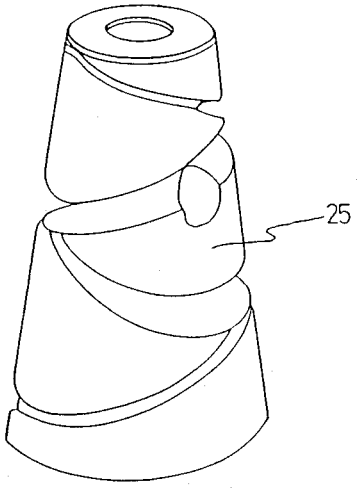
FIG. 5 is a perspective view of a model drum.

(II) Soluble model manufacturing process:

A model drum 25 as shown in FIG. 5 is formed by a soluble material.

Figure 6:
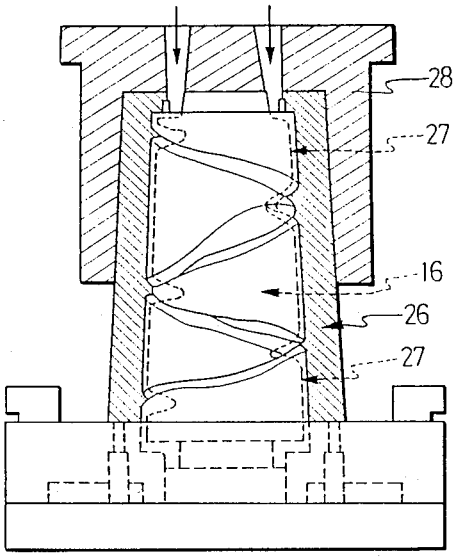
FIG. 6 is a sectional view for assistance in explaining a process for forming the model drum.

A female mold 26 of the same construction as that of the female mold 17, and having an inner configuration corresponding to a traverse drum to be manufactured is used. The female mold 26 is opened as illustrated in FIG. 8 and the soluble core 16 is placed in the middle of the segments of the female mold 26. Then, the segments of the female mold 26 are closed as shown in FIG. 7 to form a limited space 27 between the soluble core 16 and the female mold 26 as shown in FIG. 6. Then, a molten second meltable substance is poured ((c) in FIG. 2) into the limited space 27. The second meltable substance is such a substance which remains solid under a condition under which the first soluble substance forming the soluble core 16 is dissolved, for example, a substance which melts when heated at a temperature in the range of 60° to 120° C., such as an ordinary wax.

After the second meltable substance poured into the limited space 27 has solidified, as in the process I, the female mold 26 is opened radially to take out the meltable model ((d) in FIG. 2) combined with the soluble core 16. Then, the meltable model combined with the soluble core 16 is dipped in water of an ordinary temperature to dissolve the soluble core 16 ((e) in FIG. 2). Thus the model drum 25 having substantially the same morphology as that of the traverse drum to be manufactured as shown in FIG. 5 is manufactured ((f) in FIG. 2). The size of the model drum 25 is greater than that of the furnished traverse drum by a value corresponding to the contraction of the cast traverse drum.

(III) Molding shell manufacturing process.

The surface of an aggregate formed by joining a pouring cap 29 formed by the same material as that of the model drum 25 to the model drum 25 is cleaned perfectly with a detergent or the like, and then the aggregate (FIG. 10) of the model drum 25 ((g) in FIG. 2) and the pouring cap 29 are dipped ((h) in FIG. 2) in a specified mixed liquid A to coat the surface of the aggregate with a film of a refractory substance ((i) in FIG. 2). The mixed liquid A is, for example, a mixed liquid of zirconium powder and ethylsilicate. Suitable temperature and zirconium concentration of the mixed liquid A are 20° to 30° C. and 40 to 50%, respectively. After dipping the aggregate of the model drum 25 and the pouring cap 29 in the mixed liquid, the surface of the aggregate is covered with zirconium sand, and then the aggregate covered with zirconium sand is dried moderately. After drying, the aggregate is dipped in another mixed liquid B, for example, a mixed liquid of zirconium sand and sodium silicate. After dipping, the surface of the aggregate is covered with a refractory substance, such as chamotte sand. Then, after drying, the aggregate is dipped further in a mixed liquid C, for example a mixed liquid of mullite powder and ethylsilicate, and then the surface of the aggregate is covered with a refractory substance such as molokite. Thus the dipping treatment and the refractory substance application treatment are repeated alternately five to ten times ((j) in FIG. 2) to form a shell 30 of 6 to 15 mm in wall thickness, namely a shell having walls of a thickness suitable for pouring molten metal therein and facilitating the removal of the casting therefrom.

Figure 10:
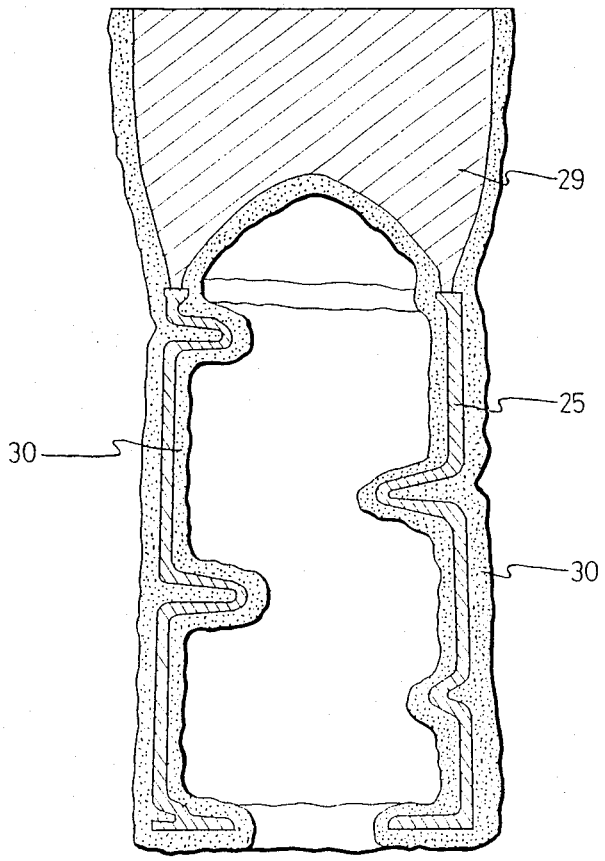
FIG. 10 is a sectional front elevation for assistance in explaining the manner of forming a refractory shell.

As shown in FIG. 10, after drying the meltable model drum 25 covered with the shell 30 of refractory substances for a fixed period of time, the aggregate of the model drum 25 and the pouring cap 29 is melted under a fixed condition to produce the refractory shell 30 ((k)in FIG. 2) having a cavity of a predetermined form. The refractory shell 30 is burned at a high temperature (900° to 1100° C.) to burn out impurities.

Figure 11:
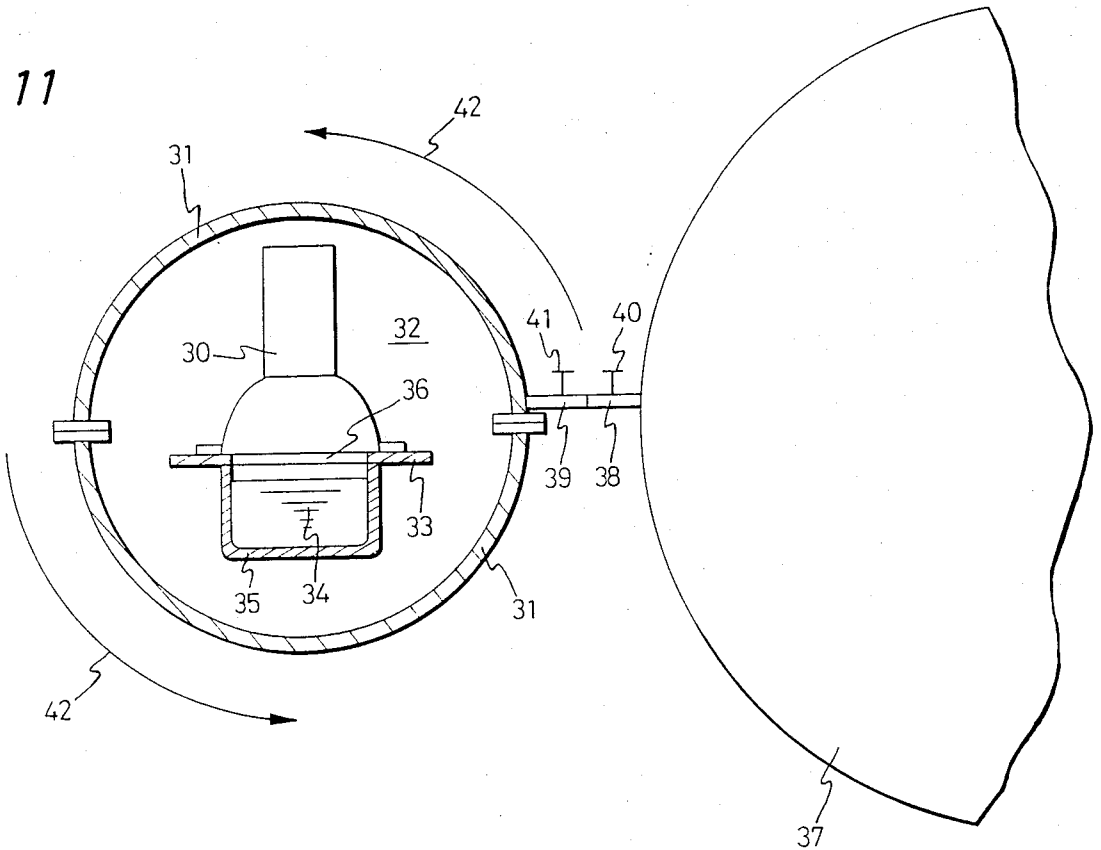
FIG. 11 is a schematic illustration of an exemplary vacuum casting apparatus.

(IV) Vaccum pouring process:

A molten material of the traverse drum, a molten iron metal in this embodiment, is poured instantaneously ((l) in FIG. 2) into the limited narrow cavity of the refractory shell under an evacuated oxygen-free condition to cast a traverse drum. FIG. 11 shows an exemplary apparatus for casting the traverse drum. As shown in FIG. 11, the refractory shell 30 is placed on a fixed plate 33 disposed in a casting chamber 32 closed with a cover 31. A container 35 containing a molten metal 34 is attached to the lower side of the fixed plate 33. A hole 36 for allowing the molten metal to flow into the refractory shell is formed in the fixed plate 33.

After the refractory shell 30 has been set in the apparatus, the casting chamber 32 is connected through pipes 38 and 39 to a vacuum tank 37 to evacuate the interior of the casting chamber 32 in an oxygen-free evacuated state of an appropriate degree of vacuum. The vacuum tank 37 has a capacity far greater than that of the casting chamber 32, and hence the interior of the casting chamber 32 is evacuated instantaneously when valves 40 and 41 are opened. After the casting chamber 32 has been evacuated to a predetermined degree of vacuum, the valves 40 and 41 are closed, then the tubes 38 and 39 are separated, and then the casting chamber 32 is turned through an angle of 180° in a direction indicated by an arrow 42 by a driving source, not shown, in an extremely short time (about 0.5 sec), so that the molten metal 34 contained in the container 35 is poured instantaneously into the cavity having the form of the traverse drum of the shell 30. Since the cavity having the form of the traverse drum has grooves of a complicated form, the molten metal is oxidized before the molten metal flows into the peripheral portions of the cavity and is unable to flow into the peripheral portions of the cavity, when the molten metal is powered into the cavity of the shell in the atmosphere. According to the present invention, since the molten metal is power into the cavity of the shell in an oxygen-free condition, the molten metal flows instantaneously into the peripheral portions of the cavity of the shell 30 without being oxidized.

(V) After treatment and finishing process:

The refractory shell is broken to take out an as-cast metallic drum. The as-cast metallic drum is annealed to relieve the casting stress. After annealing, the metallic drum is subjected to processes for correcting the roundness and for balance adjustment, and then the surface and the grooves of the metallic drum are polished by lapping or buffing to finish the surface and the grooves in surfaces having a small coefficient of friction ((m) in FIG. 2).

Furthermore, to harden further the surfaces of the drum and the grooves, the metallic drum is subjected to surface treatment ((n) in FIG. 2). A suitable method of surface treatment is selected taking into consideration the desired surface hardness of the traverse drum and the cost of surface treatment. For example, ionitriding or ion plating raises the surface hardness of the as-cast drum (200 to 400 Hv) up to a hardness in the range of 800 to 2000 Hv. Thus the traverse drum having excellent abrasion resistance is manufactured ((o) in FIG. 2).

FIG. 2 is a block diagram of the above-mentioned method for manufacturing the traverse drum. As shown in FIG. 2, the method according to the present invention comprises the process I for forming the soluble core 16, the process II for forming the model drum 25 by using the soluble core 16, the process III for forming the refractory shell 30 by using the model drum 25, the process IV for pouring a molten metal into the refractory shell 30 in an oxygen-free atomosphere, and the process V including the surface treatment and finishing of the casting 43. As mentioned hereinbefore, the finished drum 1 manufactured by the manufacturing method of the present invention meets the every requisite condition of the traverse drum for an automatic winder.

The materials and processing liquids employed in the above-mentioned processes may be of any kind and various materials and various combinations of materials may be employed provided that those materials and processing liquids meet the requisite conditions of the traverse drum and the method for manufacturing the same according to the present invention. For example, in the embodiment described hereinbefore, the core 16 and the model drum 25 are formed by a urea resin and a natural wax, respectively, however, the core 16 may be formed by a material which is soluble in a chemical, while the model drum 25 may be formed by a material which is soluble in another chemical. Naturally, the refractory substances for covering the model drum may be easily available refractory substances other than zirconium sand, chamotte sand and molokite.

Furthermore, in forming parts or combinations of parts having a comparatively simple form by a metal other than an iron metal and ferroalloys, such as a zinc alloy, an aluminum alloy, a magnesium alloy or a copper alloy, either casting in an evacuated oxygen-free atmosphere or in the atmosphere is possible.

As apparent from the foregoing description, according to the present invention, a lightweight traverse drum of an iron metal and a ferroalloy, having extremely thin walls, excellent electric conductivity and excellent abrasion resistance can be manufactured.

What is claimed is:

1. A traverse drum for surface driving a take-up package in an automatic yarn winder having a yarn supply package, said traverse drum being formed of an iron metal and having at least one yarn guide groove in the exterior wall thereof for guiding yarn from said supply package to said take-up package, said traverse drum having thin walls, wherein the thickness of the wall of the guide groove and the cylindrical body is approximately 1.5 to 2.5 mm.

2. A traverse drum for surface driving a take-up package in an automatic yarn winder having a yarn supply package, comprising:

a thin iron metal drum wall; and guide means, formed in said drum wall, for directing yarn from the supply package to the take-up package in the automatic winder;

said guide means having a first groove and a second groove crossing said first groove, wherein said first groove is deeper than said second groove;

wherein said drum wall thickness is less than 2.5 millimeters.

3. A traverse drum for guiding a yarn from a yarn supply package to a yarn take-up package in an automatic winder, said drum comprising:

an electrically conductive body capable of conducting static electricity generated during a winding operation; and an abrasion-resistant surface on said body for contacting yarn;

said conductive body being formed of thin iron metal; and said conductive body being less than 2.5 millimeters thick.

* * * * *